US005367827A

United States Patent [19]

Tajima et al.

[11] Patent Number: 5,367,827

[45] Date of Patent: Nov. 29, 1994

[54] WIRE GUIDE STRUCTURE FOR POWER WINDOW

[75] Inventors: Keiichi Tajima; Toshiyuki Tsukamoto, both of Shizuoka, Japan

[73] Assignee: Koito Manufacturing Co., Ltd., Tokyo, Japan

[21] Appl. No.: 145,624

[22] Filed: Nov. 4, 1993

[30] Foreign Application Priority Data

Nov. 5, 1992 [JP] Japan ..... 4-082259

[51] Int. Cl.[5] ..... E05F 11/48

[52] U.S. Cl. ..... 49/352; 49/348; 242/364

[58] Field of Search ..... 49/348, 349, 352; 242/100.1; 254/383

[56] References Cited

U.S. PATENT DOCUMENTS

| | | | |
|---|---|---|---|
| 3,208,121 | 9/1965 | Price | 242/100.1 X |
| 4,442,632 | 4/1984 | Greco et al. | 49/352 |
| 4,603,476 | 8/1986 | Tarbox | 242/100.1 X |
| 4,970,911 | 11/1990 | Uiihara et al. | 49/352 X |
| 4,995,568 | 2/1991 | Yamagishi et al. | 49/352 X |

FOREIGN PATENT DOCUMENTS

| | | | |
|---|---|---|---|
| 2803807 | 8/1979 | Germany | 49/352 |
| 2029502 | 3/1980 | United Kingdom . | |
| 2199889 | 7/1988 | United Kingdom . | |

*Primary Examiner*—Peter M. Cuomo
*Assistant Examiner*—Jerry Redman
*Attorney, Agent, or Firm*—Sughrue, Mion, Zinn, Macpeak & Seas

[57] ABSTRACT

A power window device in which a drive pulley around which a wire to open and close a window is wound is disposed within a case of a power window drive section and a wire guide for guiding the wire is mounted on the case. The wire guide is composed of a first wire guide for guiding one end of the wire and a second wire guide for guiding the other end of the wire. The second wire guide is removably coupled to the first wire guide. A wire guide angle $\theta_0$ between the wire guides can be changed merely by exchanging the second wire guide. Even when a different wire guide angle is required, the size of the component to be replaced can be reduced, as can the cost to manufacture.

9 Claims, 5 Drawing Sheets

WIRE GUIDE STRUCTURE FOR POWER WINDOW

BACKGROUND OF THE INVENTION

The present invention relates to a power window device for opening and closing a window of a vehicle, for example, a motor car. More particularly, the invention relates to a structure for guiding a wire to move a window glass for opening ana closing a window.

In a general power window device, a window glass vertically moved by a drive source, such as a motor, for opening and closing a window. The construction of a conventional power window device is shown in FIG. 5. A rail extends vertically in the car body under the window. A slider 2 is supported by the rail 1 in a state such that the slider is slidable along the rail 1. A wire 3 is connected to the slider 2, with one end part thereof extending upward from the upper side of the slider 2 and the other end part extending downward from the lower side thereof. The wire 3 passes around pulleys 4 located at the top and the bottom of the rail 1, and is coupled to a power window drive section 5. A motor 6 (drive source) is provided in the power window drive section 5. The motor 6, when driven, turns a drive pulley 7 rotatably mounted in the power window drive section 5. When the drive pulley 7 is turned, the wire 3, wound around the drive pulley 7, pulls the slider 2 up or down. A window glass 8 is mounted on the slider 2. The window 8 is vertically moved together with the slider 2 to open and close a window space defined by a sash (window frame), not shown. Outer tubes 9 for guiding the wires 3 are provided between the power window drive section 5 and the top pulley 4, and between the same and the bottom pulley 4.

The power window device thus constructed uses a guide for guiding the wires coupled to the power window drive section. An example of the wire guide will be described.

As shown in FIG. 6, a wire guide 30 having a pair of tubular guides 31 and 32, which diverge from a common point at a given guide angle, is made of resin. The wire guide 30 is fastened around the tubular portion 33 of a case accommodating the drive pulley 7 so that the pair of tubular guides 31 and 32 extend in the tangential direction of the drive pulley 7. With provision of the wire guide 30, the wire 3 wound around the drive pulley 7 is inserted into the pair of tubular guides 31 and 32. The pair of tubular guides 31 and 32 determine the course of the wire 3 to the drive pulley 7 so as to secure smooth driving of the wire.

However, in the thus-constructed wire guide, the paired tubular guides and the wire guide are constructed in a one-piece construction. Thus, if the guide angle of the wire to the drive pulley is changed, the wire guide cannot flexibly accept the changed guide angle.

An example in which the power window drive section 5 must be mounted at a location different from that of the rail 1 shown in FIG. 5 and is illustrated in detail FIG. 7. As shown, in a first type of car the wire guide is mounted on the rail 1 as indicated by a solid line, while in a second type of car it must be mounted as indicated by a two-dot chain line. Thus, the angle of the wire extending in the tangential direction of the pulleys 4 (FIG. 5) located at the top and bottom must be changed.

In this example, a wire guide having a wire guide angle $\theta_2$ must be used, although the wire guide angle of the wire guide for the first type of car is $\theta_1$. Accordingly, the whole wire guide must be replaced with another one. That is, different types of wire guides having respective different guide angles, which are in conformity with different standards of various car models equipped with power window devices, must be manufactured. Therefore, a corresponding number of molds for manufacturing the wire guides is required. The size of the required mold is large since the whole wire guide must be molded in a one-piece construction. Such a mold is very expensive, so that the cost to manufacture is remarkably high.

SUMMARY OF THE INVENTION

Accordingly, an object of the present invention is to provide a wire guide structure for a power window device for which, when a different wire guide angle is required, the size of the exchanged components and the mold for manufacturing them is reduced, and the cost to manufacture is reduced.

To achieve the above object, there is provided a power window device in which a drive pulley, around which a wire to open and close a window is wound, is disposed within a case of a power window drive section and a wire guide for guiding the wire is mounted on the case, characterized in that the wire guide includes a first wire guide for guiding one end of the wire and a second wire guide for guiding the other end of the wire.

DESCRIPTION OF THE PREFERRED EMBODIMENTS

Figure 1:
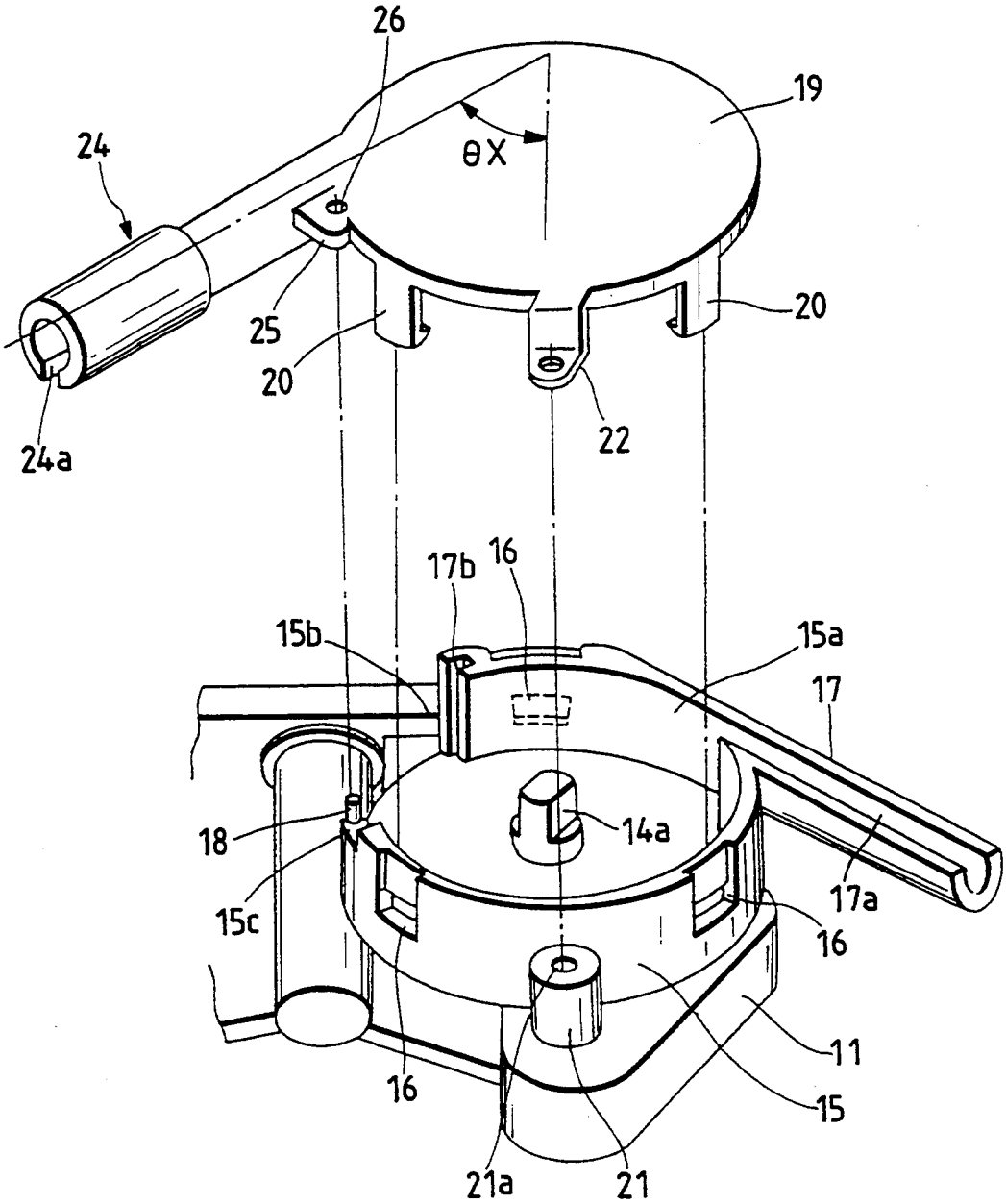
FIG. 1 is a partially exploded view in perspective of a key portion of a power window drive section incorporating the present invention when viewed from the rear side thereto.
Figure 2:
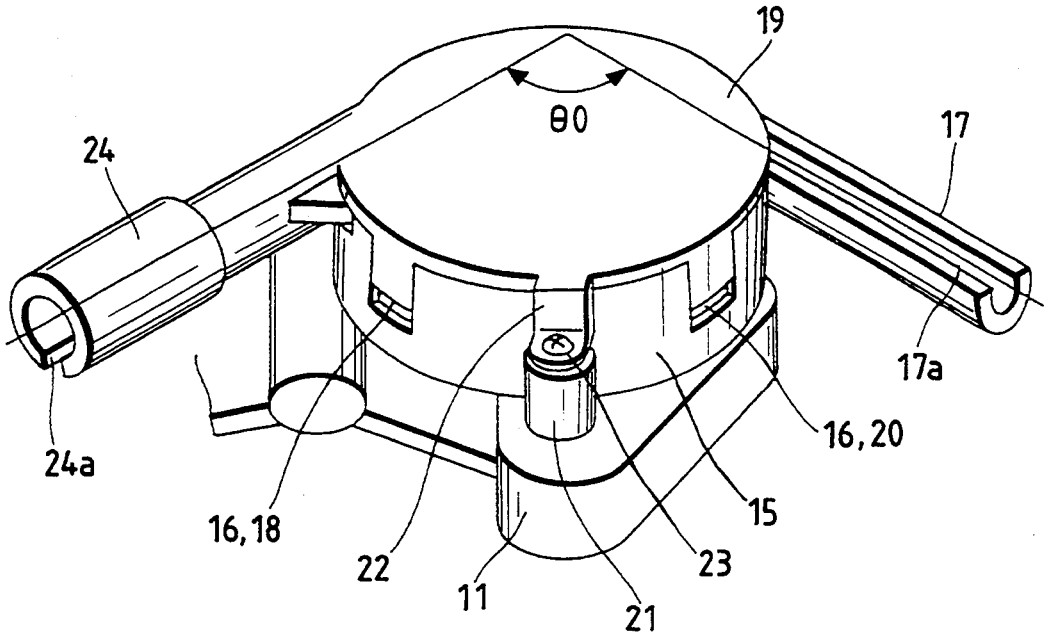
FIG. 2 is a perspective view showing a key portion of the power window drive section shown in FIG. 1 when it assembled.
Figure 3:
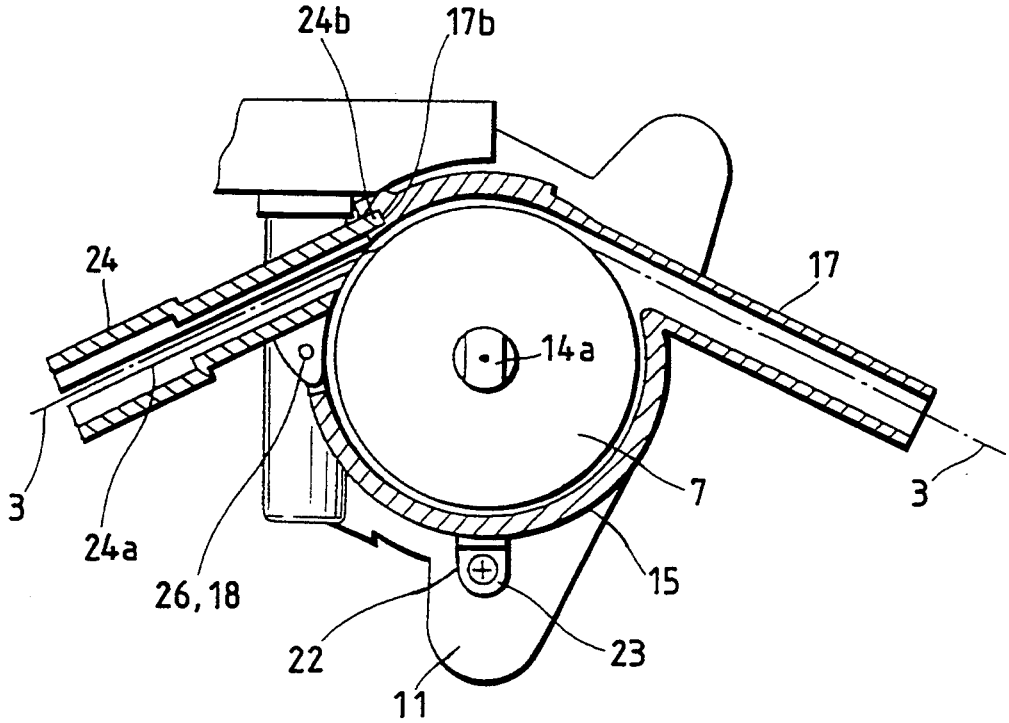
FIG. 3 is a cross-sectional view showing the key portion of the power window drive section with the upper part thereof cut away.
Figure 4:
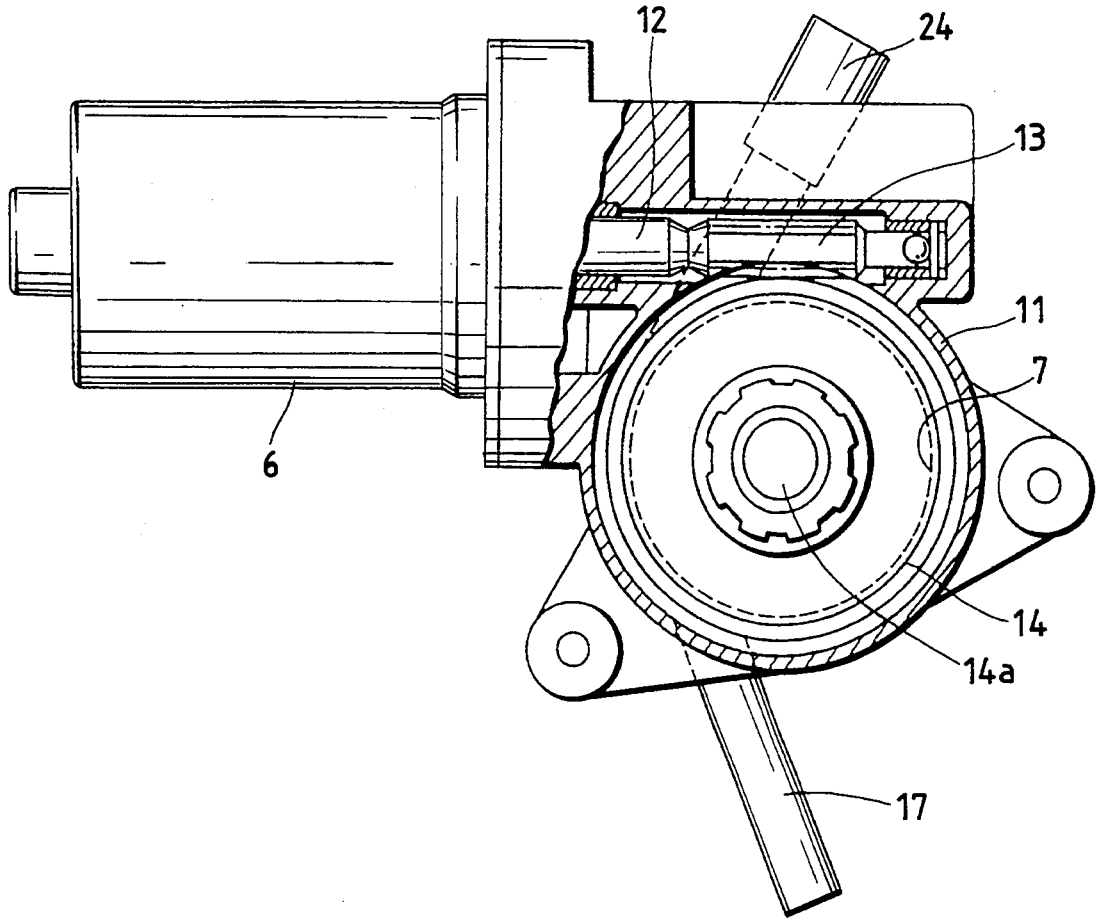
FIG. 4 a front view, partly cut away, showing a part of the internal structure of the power window drive section.

The present invention will be described with reference to the accompanying drawings. FIG. 1 is an exploded view in perspective of a key portion of a power window drive section incorporating the present invention when viewed from the rear side thereof. FIG. 2 is a perspective view showing a key portion of the power window drive section shown in FIG. 1 when it is assembled. FIG. 3 is a cross-sectional view showing the key portion of the power window drive section with the upper part thereof cut away. FIG. 4 is a front view, partly cut away, showing a part of the internal structure of the power window drive section.

Figure 5:
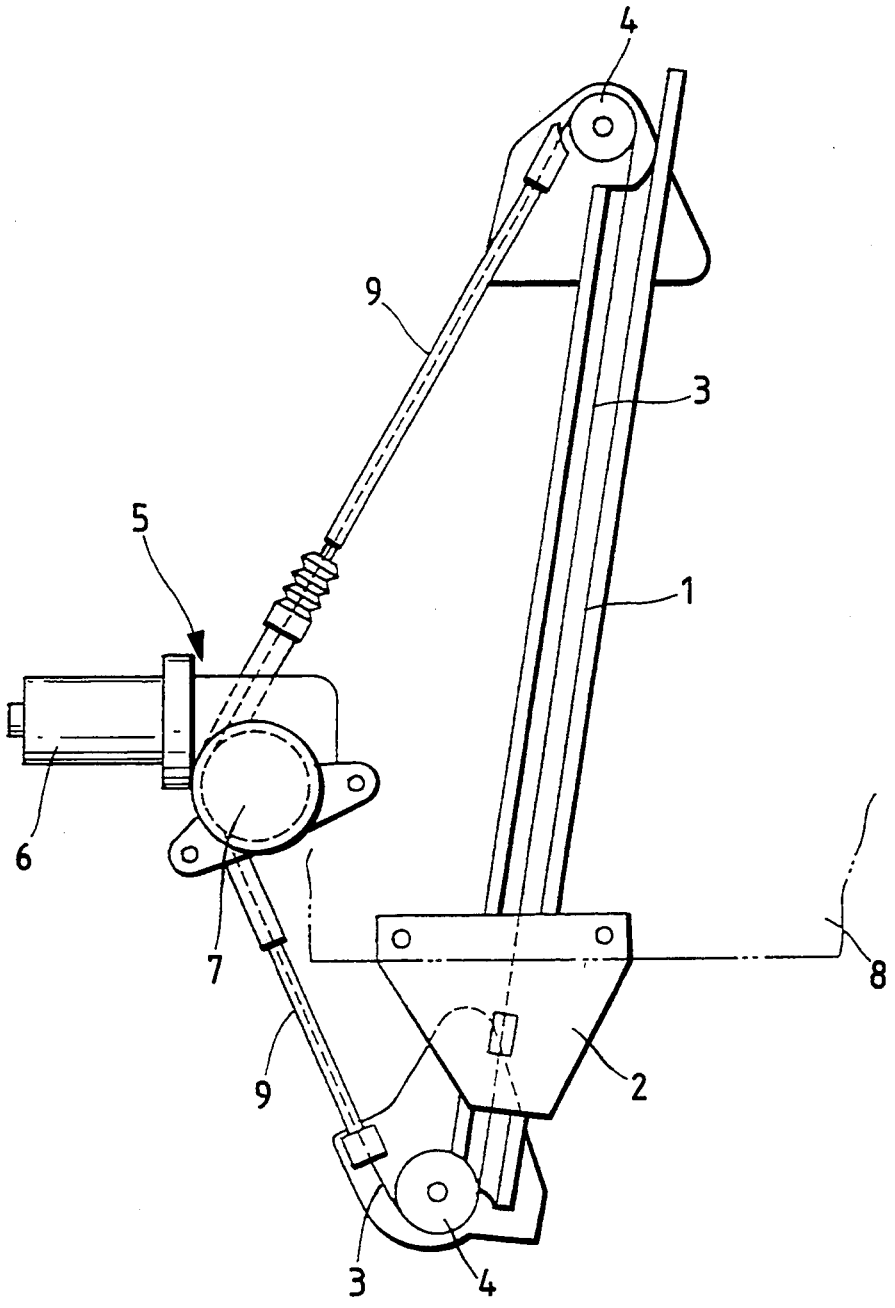
FIG. 5 PRIOR ART
FIG. 5 is a front view showing the overall construction of a power window device to which the present invention can be applied.
Figure 6:
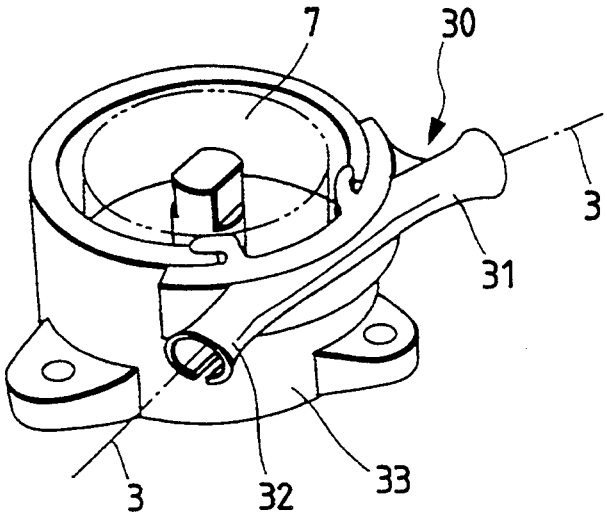
FIG. 6 PRIOR ART
FIG. 6 is a perspective view showing an example of a conventional wire guide.
Figure 7:
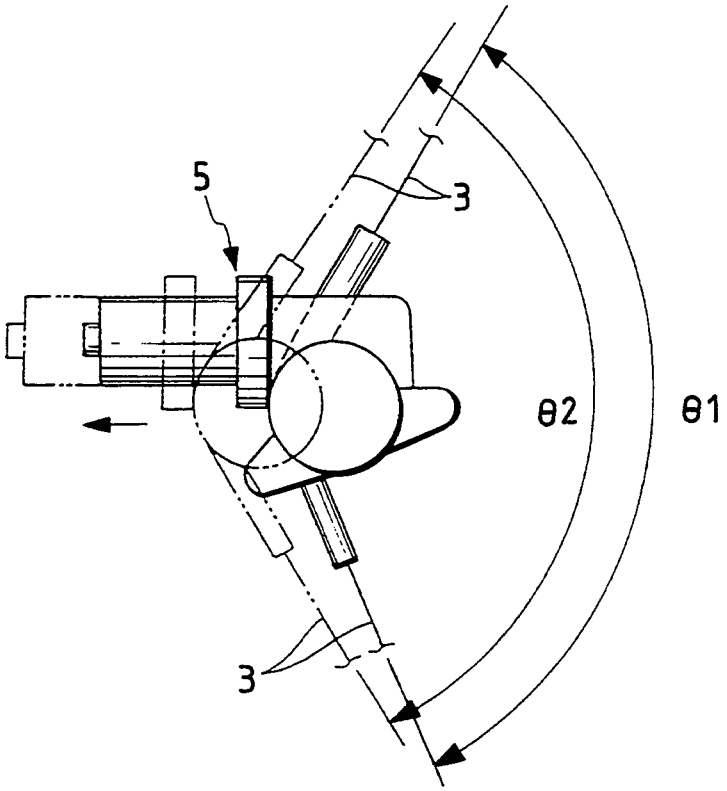
FIG. 7 PRIOR ART
FIG. 7 is a diagram used in explaining the problems of a conventional power window device.

In FIG. 4, in the power window drive section 5 shown in FIG. 5, a motor 6 is mounted on a case 11. The distal end portion of the drive shaft 12 of the motor 6, which extends in the case 11, is formed as a worm gear 13. A worm wheel 14 of a large diameter to be in mesh with the worm gear 13 is rotatively disposed within the case 11. The rotation shaft 14*a* of the worm wheel 14 stands erect at the center of the motor 6. The drive pulley 7 provided within a circular wall 15 is fitted to the shaft 14*a*, and coaxially fixed thereto. Each of the second end portions of the wire 3 of the power window device is wound around the drive pulley 7 and fixed thereto.

Lance holes 16 are opened at a plural number of locations in the circular wall 15. A lower wire guide 17, formed at a cut-out portion 15*a*, is integral with the circular wall 15. The lower wire guide 17, shaped like a slender tube, extended in the tangential direction of the circular wall A groove 17*a* is longitudinally formed in a part of the tubular guide. The groove 17*a* is used for inserting the wire 3 into the lower wire guide 17. A groove 17*b* is formed in the thick base of the lower wire guide 17. The circular wall 15 is stepped down at the location where another cut-out portion 15*b* starts, thereby forming a stepped part 15*c*. A pin 18 stands erect on the stepped part 15*c*.

A disk-like cover 19 is provided for closing the top opening of the circular wall 15. When the cover 19 is coupled with the circular wall 15 to close the top opening, lance pieces 20 protruding from the circumferential edge of the cover 19 are fit into the lance holes 16 of the circular wall 15. A boss 21 with a tapped hole 21*a* is erected on a part of the case 11. A leg 22 with a holed base part, shaped like an L in cross section, protrudes from the circumferential edge of the cover 19. In assembling the wire guide, the holed base part of the leg 22 is set on the boss 21, and a screw 23 (FIG. 2) is screwed into the hole of the base part of the leg 22 and the tapped hole 21*a* of the boss 21. The use of the screw 23 gives additional strength to the attachment of the cover 19 to the circular wall 15. When the lance structure can provide sufficient attachment of the cover to the circular wall, the screw 23 may be omitted.

An upper wire guide 24, shaped like a slender tube, extends outward from a part of the cover 19 in the tangential direction of the cover. The upper wire guide 24 is inserted into the cut-out portion 15*b* of the circular wall 15. A groove 24*a* is longitudinally formed in the bottom surface of the upper wire guide 24. The groove 24*a* is used for inserting the wire 3 into the upper wire guide 24.

A protruded area 25 with a hole 26 is formed in the bas part of the upper wire guide 24. The pin 18 protruding from the stepped part 15*c* is inserted into the hole 26 of the protruded area 25.

In the power window device thus constructed, the lower wire guide 17 and the upper wire guide 24 are resin molded separately. The upper wire guide 24 is assembled to the lower wire guide 17. The lower wire guide 17 is integral with the case 11 and the circular wall 15. The upper wire guide 24 is firmly mounted on the lower wire guide 17 by attaching the cover 19 to the circular wall 15. In this assembling work, the base end 24*b* of the upper wire guide 24 is fitted into the groove 17*b* of the lower wire guide 17. The lance pieces 20 of the cover 19 are fit into the respective lance holes 16 of the circular wall 15. The hole 26 in the base part of the upper wire guide 24 is fitted to the pin 18 of the hole 26. Thus, the upper wire guide 24 is positioned and firmly coupled with the lower wire guide 17. Then,.the coupled components are further firmly coupled by means of the screw 23, if required.

In this way, as shown in FIGS. 2 and 3, the lower wire guide 17 and the upper wire guide 24 are firmly coupled into a wire guide of a required guide angle $\theta_0$. In the power window device, the lower wire guide 17 and the circular wall 15 are molded in a one-piece construction. The resultant lower wire guide 17 has a high geometrical accuracy, minimizing looseness of the wire caused by dimensional errors of the wire guide. Because of the one-piece construction, a force to separate the cover 19 and the upper wire guide 24 is applied to only the upper wire guide 24. A large force is not required for attaching the cover 19 to the circular wall 15. Accordingly, use of only the lance coupling suffices for the attachment of the cover to the circular wall, and the further coupling by the screw 23 is omissible.

In a situation where wire guides of different angles for the upper wire guide 24 to the lower wire guide 17 are required, the requirement is satisfied by previously manufacturing the molded products of different angles $\theta_x$ of the upper wire guide 24 to the reference line of the cover 19 shown in FIG. 1, that is, different types of one-piece molded products for the upper wire guide 24 and the cover 19. In use, a molded product for a required guide angle may be selected from among those products. Thus, only one of the components of the power window device must be manufactured so as to have different specifications. This means that the components which have to be different may be reduced in size and thickness compared with those in the conventional power window device in which the whole wire guide must be replaced. Further, the size of the mold for manufacturing the components is reduced, so that the cost to manufacture is considerably reduced.

As described above, a wire guide mounted on a case containing a drive pulley includes a first wire guide for guiding one end of the wire and a second wire guide for guiding the other end of the wire. A different wire guide angle can be achieved merely by changing the angle between the wire guides. The result is a reduction in the size of the components which must be change to accommodate a different angle, the use of the mold of a small size, and a reduction of the total cost to manufacture.

What is claimed is:

1. In a power window device in which a drive pulley around which a wire for opening and closing a window is wound is disposed within a case of a power window drive section and a wire guide for guiding the wire is mounted on the case, the improvement wherein said wire guide comprises a first wire guide for guiding one end of the wire and a second wire guide for guiding the other end of the wire removably coupled to the first wire guide, and means for removably and irrotationally fixing said first wire guide and said second wire guide to one another.

2. The power window device of claim 1, wherein said fixing mean comprises lance coupling means for coupling said second guide to said first guide.

3. The power window device of claim 2, wherein said fixing means further comprises screw means for coupling said second guide to said first guide.

4. The power window device of claim 1, wherein said case comprises a circular wall portion, said first wire guide being formed integrally with said circular wall portion.

5. The power window device of claim 4, wherein said case further comprises a generally flat cover member, said second wire guide being formed integrally with said cover member.

6. The power window device of claim 5, wherein said fixing means comprises a plurality of lance pieces formed integrally with said cover member, said lance pieces having end portions received in corresponding lance holes formed in an outer wall of said circular wall portion.

7. The power window device of claim 6, wherein an end portion of said second wire guide is received in a cut-out portion of said circular wall.

8. The power window device of claim 7, further comprising a pin extending upright from a stepped portion of said circular wall, said pin being received in a hole in said cover.

9. The power window device of claim 1, wherein said first and second wire guides have the shape of a tube cue away on a side thereof.

* * * * *